US011156066B2

(12) United States Patent
Sullivan et al.

(10) Patent No.: US 11,156,066 B2
(45) Date of Patent: Oct. 26, 2021

(54) PERFORATING GUN ORIENTING SYSTEM, AND METHOD OF ALIGNING SHOTS IN A PERFORATING GUN

(71) Applicant: XConnect, LLC, Denver, CO (US)

(72) Inventors: Shelby L. Sullivan, Minot, ND (US); Aaron Holmberg, Omaha, NE (US)

(73) Assignee: XConnect, LLC, Denver, CO (US)

( * ) Notice: Subject to any disclaimer, the term of this patent is extended or adjusted under 35 U.S.C. 154(b) by 0 days.

(21) Appl. No.: 16/833,114

(22) Filed: Mar. 27, 2020

(65) Prior Publication Data

US 2020/0308938 A1 Oct. 1, 2020

Related U.S. Application Data

(60) Provisional application No. 62/827,497, filed on Apr. 1, 2019.

(51) Int. Cl.
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC .... E21B 43/119; E21B 43/116; E21B 17/042; E21B 17/028
See application file for complete search history.

(56) References Cited

U.S. PATENT DOCUMENTS 387,475 A 8/1888 Whaling
2,296,198 A 9/1942 Boynton
2,314,867 A 3/1943 Boynton
7,213,655 B2 5/2007 Parrott
7,793,994 B2 9/2010 Boyd
7,886,842 B2 2/2011 Howard et al.
8,028,751 B2 10/2011 Pinto et al.
8,186,259 B2 5/2012 Burleson et al.
8,684,083 B2 4/2014 Torres et al.
9,115,572 B1 8/2015 Hardesty et al.
9,399,897 B2 7/2016 Stokes
9,500,071 B2 11/2016 Morgan-Smith et al.
9,523,266 B2 12/2016 Arena
9,644,460 B2 5/2017 Bell et al.
9,689,223 B2 6/2017 Schacherer et al.
9,803,455 B1 10/2017 Yang et al.
9,845,666 B2 12/2017 Hardesty et al.
9,903,185 B2 2/2018 Ursi et al.
(Continued)

*Primary Examiner* — Giovanna Wright
*Assistant Examiner* — Yanick A Akaragwe
(74) *Attorney, Agent, or Firm* — Peter L. Brewer; Thrive IP

(57) ABSTRACT

A perforating gun orienting system. The orienting system comprises a first perforating gun and a second perforating gun, with each defining a gun barrel housing having a first end and an opposing second end. The orienting system also includes a tandem sub, with the tandem sub having first and second opposing ends defining a threaded connector, and each end having a side port configured to receive an alignment screw. A first slot resides at the second end of the first perforating gun, and a second slot resides at the first end of the second perforating gun. The slots are configured to align with the side ports, allowing the operator to access alignment screws within the side ports while aligning charges of the two guns. A method of aligning shots in a perforating gun assembly using the orienting system is also provided.

19 Claims, 9 Drawing Sheets

(56) References Cited

U.S. PATENT DOCUMENTS

| | | | | |
|---|---|---|---|---|
| 10,113,401 | B2 | 10/2018 | Al-Gouhi | |
| 10,233,743 | B2 | 3/2019 | Morgan-Smith et al. | |
| 10,273,760 | B2 | 4/2019 | Cook et al. | |
| 10,316,634 | B2 | 6/2019 | Graham et al. | |
| 10,337,310 | B2 | 7/2019 | Bell et al. | |
| 10,358,897 | B2 | 7/2019 | Bowen et al. | |
| 10,392,888 | B2 | 8/2019 | Robertson et al. | |
| 10,444,392 | B2 | 10/2019 | Milne et al. | |
| 10,465,488 | B2 | 11/2019 | Collins et al. | |
| 10,472,937 | B2 | 11/2019 | Walters et al. | |
| 10,526,876 | B2 | 1/2020 | Hess et al. | |
| 10,590,706 | B2 | 3/2020 | Hess et al. | |
| 10,597,979 | B1 | 3/2020 | Eitschberger et al. | |
| 11,078,762 | B2 | 8/2021 | Mauldin et al. | |
| 2010/0089643 | A1* | 4/2010 | Vidal | E21B 43/117 175/2 |
| 2016/0061572 | A1 | 3/2016 | Eitschberger et al. | |
| 2016/0084048 | A1 | 3/2016 | Harrigan et al. | |
| 2018/0112524 | A1 | 4/2018 | Huang et al. | |
| 2019/0257181 | A1* | 8/2019 | Langford | E21B 43/119 |
| 2020/0157924 | A1 | 5/2020 | Melhus et al. | |
| 2020/0392821 | A1 | 12/2020 | Eitschberger et al. | |

* cited by examiner

PERFORATING GUN ORIENTING SYSTEM, AND METHOD OF ALIGNING SHOTS IN A PERFORATING GUN

CROSS REFERENCE TO RELATED APPLICATIONS

The present application claims the benefit of U.S. Ser. No. 62/827,497 filed Apr. 1, 2019. That application is entitled "Perforating Gun Orienting System, and Method of Aligning Shots in a Perforating Gun," and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the invention relates to the completion of a well for the production of oil and gas. More specifically still, the invention relates to a perforating gun assembly wherein the shots along the perforating guns may be radially aligned.

Technology in the Field of the Invention

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to economically "kick-off" and steer wellbore trajectories from a vertical orientation to a horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 has been completed horizontally, that is, it has a horizontal leg 156. The wellbore 100 defines a bore 10 that has been drilled from an earth surface 105 into a subsurface 110. The wellbore 100 is formed using any known drilling mechanism, but preferably using a land-based rig or an offshore drilling rig on a platform.

The wellbore 100 is completed with a first string of casing 120, sometimes referred to as surface casing. The wellbore 100 is further completed with a second string of casing 130, typically referred to as an intermediate casing. In deeper wells, that is wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. As noted, the wellbore 100 is completed horizontally, meaning that a horizontal "leg" 156 is provided. The leg 156 includes a heel 152 and a toe 154. In this instance, the toe 154 defines the end (or "TD") of the wellbore 100.

It is observed that the annular region around the surface casing 120 is filled with cement 125. The cement (or cement matrix) 125 serves to isolate the wellbore from fresh water zones and potentially porous formations around the casing string 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest j oints of the immediately surrounding casing strings. Thus, for example, a non-cemented annular area 132 is typically preserved above the cement matrix 135, and a non-cemented annular area 152 is frequently preserved above the cement matrix 150.

In order to enhance the recovery of hydrocarbons, particularly in low-permeability formations 115, the casing 150 along the horizontal section 156 undergoes a process of perforating and fracturing (or in some cases perforating and acidizing). Due to the very long lengths of new horizontal wells, the perforating and formation treatment process is carried out in stages.

In one method, a perforating gun assembly 200 is pumped down towards the end of the horizontal leg 156 at the end of a wireline 240. The perforating gun assembly 200 will include a series of perforating guns (shown at 210 in FIG. 2), with each gun having sets of charges ready for detonation.

In operation, the perforating gun assembly 200 is pumped down towards the end 154 of the wellbore 100. The charges associated with one of the perforating guns are detonated and perforations are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations (not shown) create fluid communication with the surrounding formation 115 so that hydrocarbon fluids can flow into the casing 150 and up to the surface 105.

After perforating, the operator will fracture (or otherwise stimulate) the formation 115 through the perforations (not shown). This is done by pumping treatment fluids into the formation 115 at a pressure above a formation parting pressure.

After the fracturing operation is complete, the wireline 240 will be raised and the perforating gun assembly 200 will be positioned at a new location (or "depth") along the horizontal wellbore 156. A plug (such as plug 112) is set below the perforating gun assembly 200 and new shots are fired in order to create a new set of perforations. Thereafter, treatment fluid is again pumping into the wellbore 100 and into the formation 115 at a pressure above the formation parting pressure. In this way, a second set of fractures is formed away from the wellbore.

The process of setting a plug, perforating the casing, and fracturing the formation is repeated in multiple stages until the wellbore has been completed, that is, it is ready for production. The shots create clusters of perforations to create fracture complexity and to enhance fluid communication with the formation.

In order to provide perforations for the multiple stages without having to pull the perforating gun after every detonation, the perforating gun assembly 200 employs multiple guns in series. FIG. 2 is a side view of an illustrative perforating gun assembly 200, or at least a portion of an assembly. The perforating gun assembly 200 comprises a string of perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface 105 and that delivers electrical energy down to the tool string 200. Each perforating gun 210 also includes an explosive initiator, or "detonator" (not shown). The detonator is a small aluminum housing with a resistor inside surrounded by a sensitive explosive.

In addition, each perforating gun 210 comprises a detonating cord. The detonating cord contains an explosive compound that is detonated by the detonator. Thus, the detonator receives electrical energy and passes it along to the detonator cord. The detonator cord propagates an explosion down its length to a series of shape charges. The shaped charges are held in an inner tube, referred to as a carrier tube, for security. The shape charges are discharged through openings 215 in the selected gun barrel 212.

The perforating gun assembly 200 may include short centralizer subs 220. In addition, tandem subs 225 may be used to connect the gun barrels end-to-end. Each tandem sub 225 comprises a metal threaded connector placed between the gun barrels 210. Typically, the gun barrels 210 will have female-by-female threaded ends while the tandem sub 225 has opposing male threaded ends. Further, an insulated connection member 230 connects the e-line 240 to the uppermost gun barrel 210.

The perforating gun assembly 200 and its long string of gun barrels (the housings 212 of the perforating guns 210) is carefully assembled at the surface 105, and then lowered into the wellbore 10 at the end of e-line 240. After the casing 150 has been perforated and at least one plug 112 has been set, the setting tool 120 and the perforating gun assembly 200 are taken out of the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore (typically through coiled tubing) for fracturing purposes.

As noted, the above operations may be repeated multiple times for perforating and/or fracturing the casing 150 at multiple locations, corresponding to different stages of the well. Multiple plugs and balls may be used for isolating the respective stages from each other during each perf-and-frac stage. When all stages are completed, the plugs are drilled out and the wellbore is cleaned using a circulating tool.

As the perforating gun assembly 200 leaves the hands of the operator, the assembly 200 will rotate as it gravitationally falls into the wellbore and is pumped down the horizontal leg 156. However, the operating company may desire that shots be fired not only at selected depths, but also in a selected altitude (or angle relative to horizontal). Specifically, operators may prefer that the perforations be formed in a horizontal direction. This enables fractures to propagate outwardly from the wellbore at a 90° angle.

It will be appreciated by the petroleum engineer that the size and orientation of a fracture, and the amount of hydraulic pressure needed to part the rock along a fracture plane, are dictated by the formation's in situ stress field. This stress field can be defined by three principal compressive stresses which are oriented perpendicular to one another. These represent a vertical stress, a minimum horizontal stress, and a maximum horizontal stress. The magnitudes and orientations of these three principal stresses are determined by the geomechanics in the region and by the pore pressure, depth and rock properties.

According to principles of geo-mechanics, fracture planes will generally form in a direction that is perpendicular to the plane of least principal stress in a rock matrix. Stated more simply, in most wellbores, the rock matrix will part along vertical lines when the horizontal section of a wellbore resides below 3,000 feet, and sometimes as shallow as 1,500 feet, below the surface. In this instance, hydraulic fractures will tend to propagate from the wellbore's perforations in a vertical, elliptical plane perpendicular to the plane of least principle stress. If the orientation of the least principle stress plane is known, the longitudinal axis of the leg 156 of a horizontal wellbore 100 is ideally oriented parallel to it such that the multiple fracture planes will intersect the wellbore 100 at-or-near orthogonal to the horizontal leg 156 of the wellbore.

In any instance, the perforating gun assembly must be assembled at the surface in such a way that the shots are aligned along the length of the assembly 200. Currently, a threaded adjustment collar is used to adjust the radial point at which the gun barrel housing engages the collar relative to the tandem sub when they are tightened together. Such a system is undesirable as it adds considerable length to the tool string 200.

Therefore, a need exists for an orienting system for a perforating gun assembly. Further, a need exists for an improved method of aligning charges along a perforating gun assembly for use in a wellbore. Still further, a need exists for a method of avoiding frac hits by shooting aligned perforations in one horizontal direction only.

BRIEF SUMMARY OF THE INVENTION

A perforating gun orienting system is provided herein. In one aspect, the perforating gun orienting system includes a first perforating gun and a second perforating gun. Each of the first and second perforating guns defines a tubular body serving as a gun barrel housing. The housings each have a first end and an opposing second end. Preferably, the first and second ends of each of the first and second perforating guns comprises female threads, forming a female-by-female tubular body.

The orienting system also includes a tandem sub. The tandem sub has first and second opposing ends. Each of these ends defines a male threaded connector. In addition, each of these ends includes a side port configured to receive a cap screw. Each cap screw serves as a threaded alignment screw.

A first slot is placed at the second end of the tubular housing of the first perforating gun. This first slot is configured to align with a first side port in the tandem sub upon rotation of the first perforating gun relative to the tandem sub. Similarly, a second slot is disposed at the first end of the tubular housing of the second perforating gun. The second slot is configured to align with a second side port in the tandem sub upon rotation of the second perforating gun relative to the tandem sub.

The perforating gun orienting system also includes a pair of alignment screws. Each alignment screw has a head for driving the screw into the respective first and second slots. Of interest, the first and second slots are configured to receive the alignment screws such that a head of the alignment screws clears an inner diameter of a perforating gun when threadedly run into its respective slot.

Each of the first and second slots includes a stepped surface along an inner diameter of the respective tubular housing. In one aspect, the head of each alignment screw comprises a tapered head that mates with the stepped surface. Thus, when an alignment screw is partially backed out of a tandem sub portal, it will land in the stepped surface, thereby rotationally locking the gun barrel housing relative to the tandem sub.

A method of aligning shots in a perforating gun assembly is also provided herein. In one embodiment, the method first comprises providing a first perforating gun. The first perforating gun has a tubular housing (known as a gun barrel housing) having a first end and a second opposing end.

The method also includes providing a second perforating gun. As with the first perforating gun, the second perforating gun also includes a tubular housing having a first end and a second opposing end.

The second end of the first perforating gun comprises a slot. Similarly, the first end of the second perforating gun also comprises a slot. Each slot includes a stepped surface along an inner diameter of the respective tubular housing.

The method further includes providing a tandem sub. The tandem sub has first and second opposing ends, with each end defining a male threaded connector. In other words, a male-by-male tubular body is provided. Each end of the tandem sub includes a side port. The side ports are configured to receive a threaded alignment screw.

The method additionally comprises running an alignment screw into each side port of the tandem sub such that a top of each alignment screw resides below an inner diameter of the tubular housing of the perforating guns. In one aspect, the operator simply runs the alignment screws all the way into the respective ports.

As a next step, the method includes threadedly connecting the second end of the first perforating gun with the first end of the second perforating gun. This is done using the tandem sub as a threaded intermediate. Preferably, each of the first and second ends of each of the perforating guns comprises female threads, forming a female-by-female tubular body. This allows the tandem sub to quickly and rotationally connect to the perforating guns. In one aspect, threadedly connecting the second end of the first perforating gun with the first end of the second perforating gun comprises threading each of the first and second perforating guns onto the tandem sub until a gun barrel shoulder is against a corresponding tandem sub shoulder.

The method further comprises rotationally unthreading each of the first and second perforating guns from the opposing ends of the tandem sub until the slots are lined up with the alignment screw in the respective side ports.

Also, the method includes rotationally aligning charges of each of the first and second perforating guns. This is done by further rotating each gun barrel housing relative to the tandem sub until the charges associated with each perforating gun are in linear alignment. Note that this rotational movement may be done without moving the slots out of alignment with the side ports.

Then, each alignment screw is backed out of its respective side port until a head of each alignment screw locks into an inner groove of the slot in the corresponding perforating gun. This serves to rotationally lock the tubular housing (or gun barrel housing) relative to the tandem sub. This step also serves to rotationally align charges of each of the first and second perforating guns.

Optionally, the method further comprises pumping the second perforating gun, the tandem sub and the first perforating gun into a wellbore at the end of an electric line. Optionally, charges are placed on only one side of each of the tubular housings so that perforations may be formed along the production casing in a direction opposite the direction of an adjacent parent wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 6 offers a perspective view of cap screws (or threaded alignment screws) used to fix a relative position of the two gun barrel housings relative to the tandem sub.

FIG. 10 demonstrates the use of cap screws to fix a relative position of the two gun barrel housings along the tandem sub.

ETAILED DESCRIPTION OF CERTAIN EMBODIMENTS

Definitions

Figure 1:
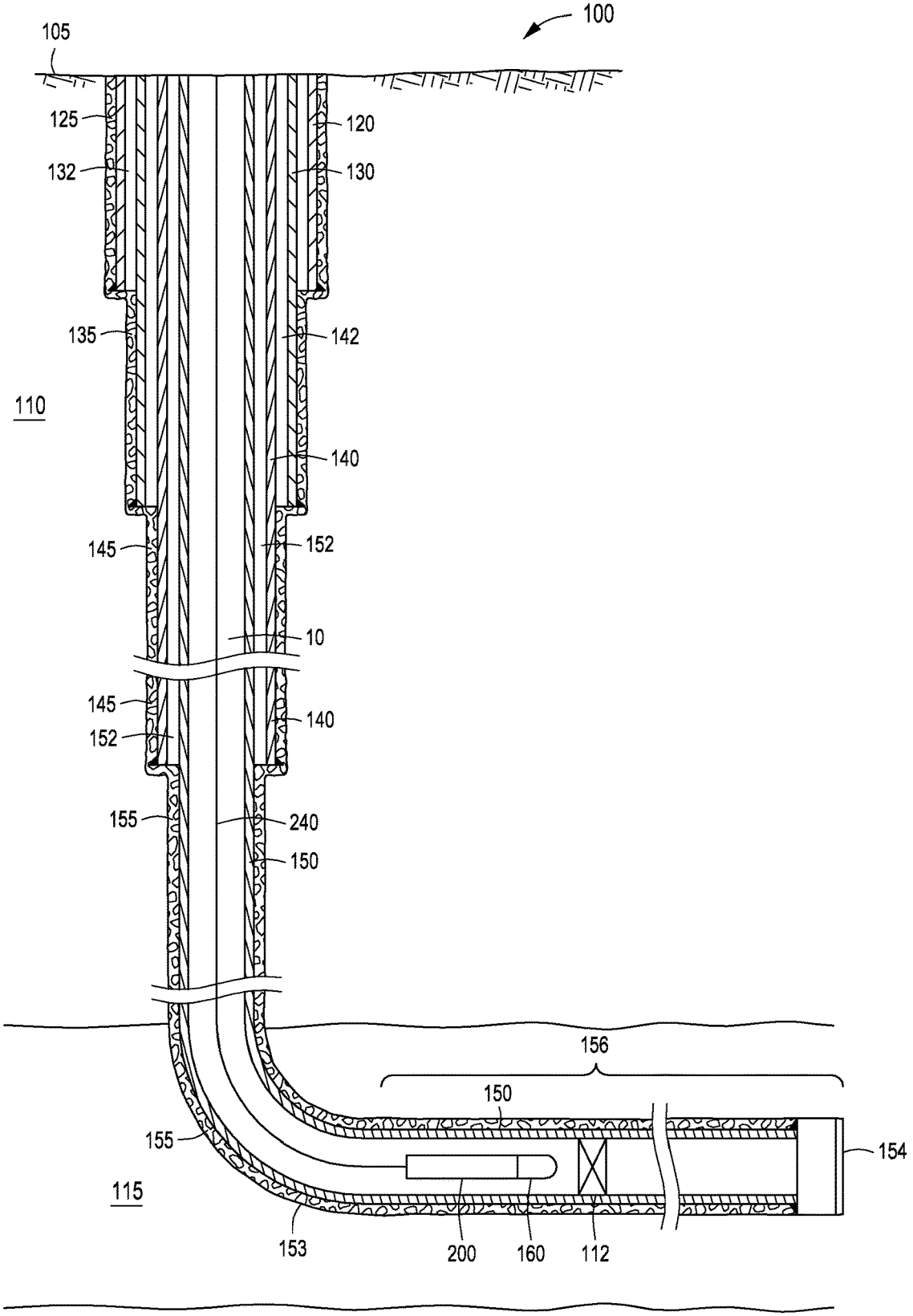
FIG. 1 (PRIOR ART)
FIG. 1 is a side, cross-sectional view of a wellbore, in one embodiment. The wellbore has been completed with an elongated horizontal section. A perforating gun assembly is shown having been pumped into the horizontal leg.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids as a slurry.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

As used herein, the term "sub" generally refers to a cylindrical body. The sub may have opposing threaded ends and is used to connect tubular bodies in series.

Reference herein to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

Description of Selected Specific Embodiments

The following description of the embodiments refers to the accompanying drawings. The same reference numbers in different drawings identify the same or similar elements.

The following detailed description does not limit the invention. Instead, the scope of the invention is defined by the appended claims. The following embodiments are discussed, for simplicity, with regard to attaching two perforating guns to each other through a tandem sub.

In the following, the terms "upstream" and "downstream" are being used to indicate that one gun barrel may be situated above and below, respectively, in relation to a given element in the well. Alternatively, "upstream" and "downstream" may refer to first and second gun barrels along a horizontal wellbore. One skilled in the art would understand that the invention is not limited only to the upstream gun or only to the downstream gun, but in fact can be applied to either gun. In other words, the terms "upstream" and "downstream" or "first" and "second" are not used in a restrictive manner, but only to indicate, in a specific embodiment, the relative positions of gun barrel housings.

Figure 3A:
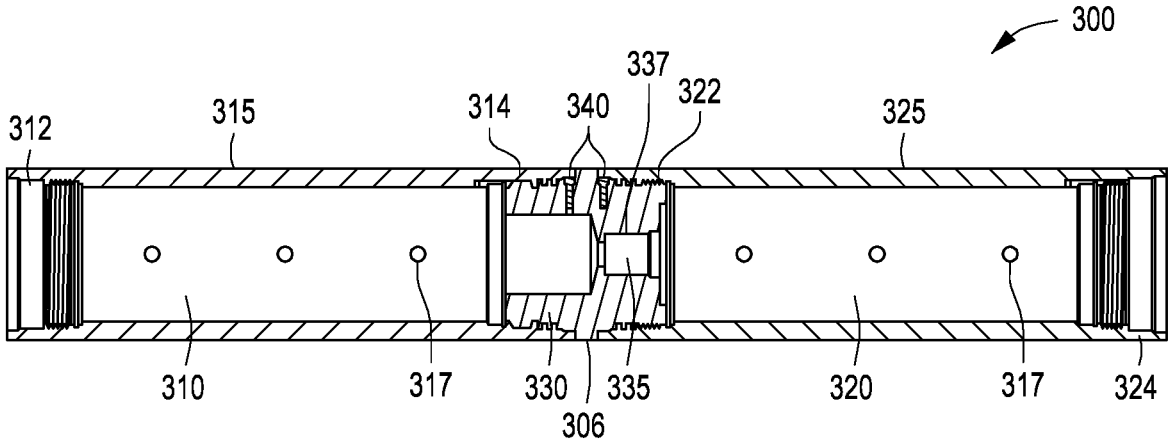
FIG. 3A is a side, cross-sectional view of a portion of a perforating gun assembly of the present invention, in one embodiment. Two gun barrel housings are seen threadedly connected by means of a novel, orienting tandem sub. Openings are shown in alignment along the gun barrel housings.

FIG. 3A is a side, cross-sectional view of a portion of a perforating gun assembly 300. The perforating gun assembly 300 includes a first perforating gun 310 and a second perforating gun 320. The first perforating gun 310 may be referred to as an upstream gun, while the second perforating gun 320 may be referred to as a downstream gun. During a casing perforating operation, the downstream gun is typically fired before the upstream gun.

Each perforating gun 310, 320 comprises a respective gun barrel 315, 325. Each of the gun barrels 315, 325 defines a tubular housing fabricated from steel (or other metal). The gun barrels 315, 325 are dimensioned to house components of any known perforating gun. Such components include a detonator and a detonator cord. The detonator receives an electrical signal from a firing head.

The detonator cord is a plastic straw packed that runs along an internal bore of the housing, and is packed with an explosive such as RDX. When current is run through the detonator, a small explosion is set off by the electrically heated resistor. This small explosion sets of the detonator cord along the selected perforating gun.

Figure 8:
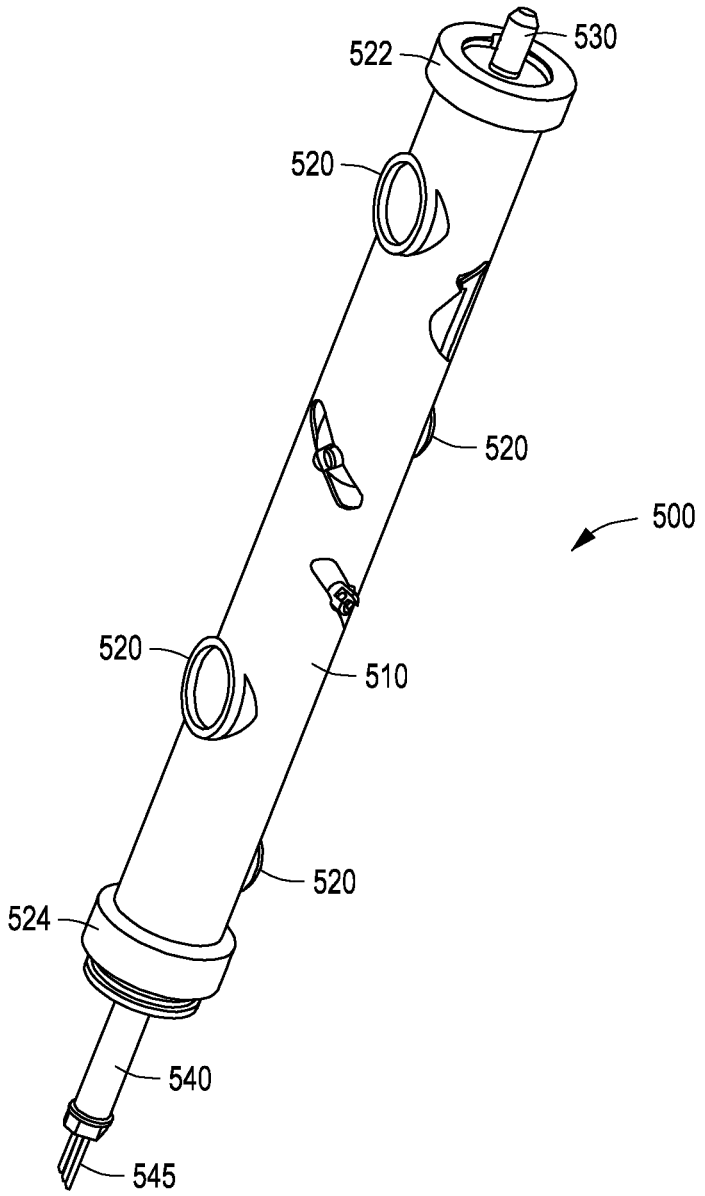
FIG. 8 is a perspective view of a carrier tube, holding charges. The carrier tube is designed to reside within a gun barrel housing.

In addition, each gun barrel 315, 325 will house a carrier tube and associated charges. An illustrative carrier tube is shown in FIG. 8, discussed below. The carrier tube secures charges, which are detonated by the detonator cord.

The first perforating gun 310 has a first end 312 and a second end 314. Similarly, the second perforating gun 320 has a first end 322 and a second end 324. When placed in a wellbore, each of the first ends 312, 322 represents an upstream end while each of the second ends 314, 324 represents a downstream end. It is understood that in "oil patch" convention, the left end of a tool indicates the upstream end while the right end of a tool represents the downstream end. In practice, each perforating gun 310, 320 may be between 18 inches and five feet in length.

As shown in FIG. 3A, the second end 314 of the first perforating gun 310 is threadedly connected to the first end 322 of the second perforating gun 320. Each end 314, 322 is a female connector, forming a female-by-female tubular body for the perforating guns 310, 320. Because each of these ends 314, 322 is a female connector, the threaded connection is made by means of a tandem sub 330.

The tandem sub 330 represents a tubular body also fabricated from steel (or other metal). The tandem sub 330 is shown in cross-section, revealing an inner bore 335. The inner bore 335 includes a bulkhead receptacle 337, meaning that a portion of the inner bore 335 is configured to closely receive a bulkhead assembly.

It is also seen that each perforating gun 310, 320 comprises a series of openings 317. The openings 317 are shown in alignment with each other. The openings 317 receive charges from respective carrier tubes. An illustrative carrier tube and charges are again shown in FIG. 8, described below.

Figure 3B:
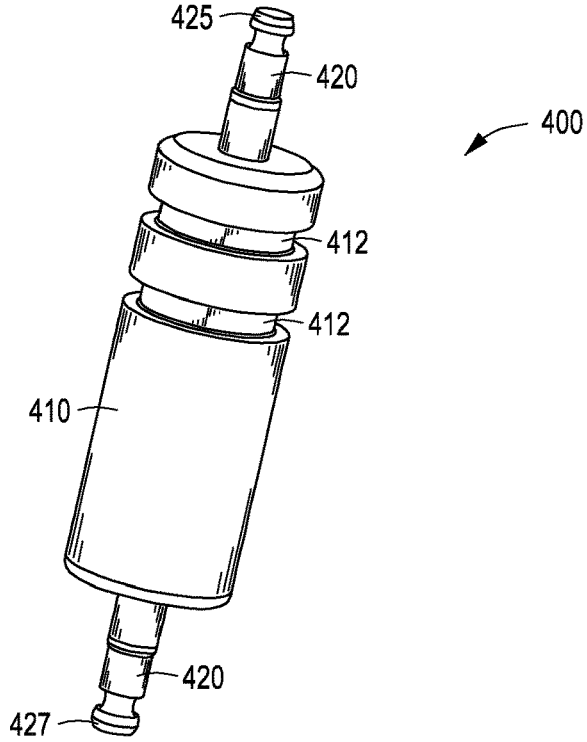
FIG. 3B is a perspective view of a bulkhead assembly that may be placed within the bore of the tandem sub. A contact pin is seen extending out of the bulkhead.

FIG. 3B is a perspective view of an illustrative bulkhead assembly 400. The bulkead assembly 400 first comprises bulkhead 410. The bulkhead 410 defines a body having a generally circular profile. The bulkhead 410 is typically fabricated from plastic or polycarbonate or other non-conductive material.

A pair of circular grooves 412 is formed along the body. The grooves 412 are dimensioned and configured to receive respective o-rings (not shown). The o-rings preferably define elastomeric seals that closely fit between an outer diameter of the bulkhead 410 and a surrounding bulkhead receptacle (not shown) within the inner bore 335. The o-rings provide a pressure seal for the bulkhead 410.

The bulkhead assembly 400 also includes a contact pin 420. The contact pin 420 defines an elongated body that is fabricated from brass, or a metal alloying comprised substantially of brass. Thus, the contact pin 420 is electrically conductive.

Figure 2A:
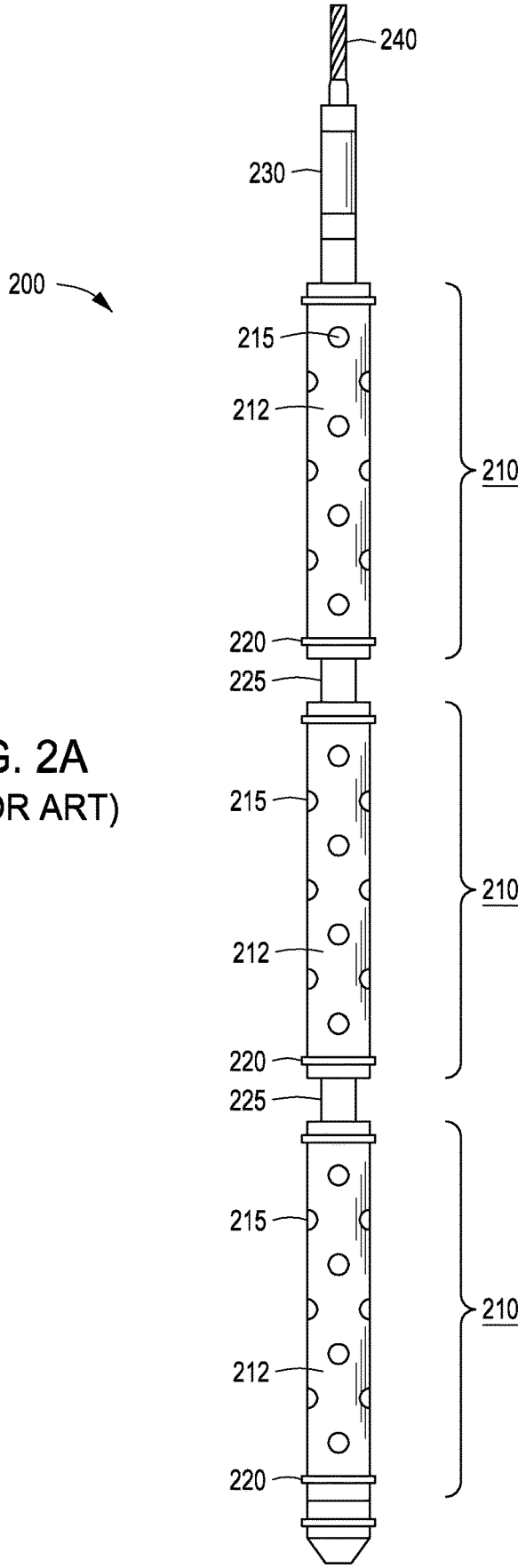
FIG. 2A (PRIOR ART)
FIG. 2A is a side view of an illustrative string of gun barrels forming a perforating gun assembly. Tandem subs are shown between gun barrels of the perforating guns, providing threaded connections.
Figure 2B:
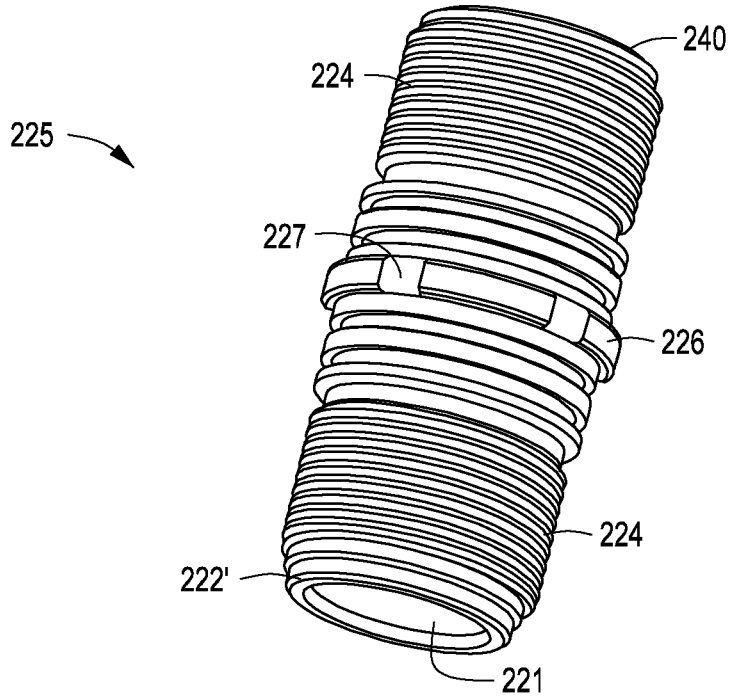
FIG. 2B is a perspective view of a tandem sub as may be used in the string of gun barrels of FIG. 2A.

Opposing ends of the contact pin 420 are seen extending out of the bulkhead 410. The tip 425, 427 of each end serves as a contact head. The contact head 425 extends into an electrical switch assembly (not shown), and delivers an initiation signal from the surface. The contact pin 420 is designed to be in electrical communication with an electrical wire that extends down through the first perforating gun 310. The wire is in electrical communication with an electric line (such as the wire 240 shown in FIG. 2) that extends down from the surface 105. The bulkhead assembly 400 serves to relay an initiation signal to the detonator head within the gun barrel 310.

In operation, the operator will send a signal from the surface 105, down the wireline 240, through the body of the pin 420, to the contact head 425 (sometimes referred to as a firing head) and to the detonator inside of a gun barrel (such as upstream gun barrel 315). The detonator ignites the explosive material within the detonator cord. From there, charges are delivered into the surrounding casing as discussed above. Where a series of gun barrels is used in a gun assembly, the signal from the wireline 240 will be transmitted through a series of bulkheads and pins to the charges to be activated, typically from the downstream end, up.

Returning to FIG. 3A, the tandem sub 330 includes a central shoulder 306. The shoulder 306 serves as a stop, or limit, to how far each end 314, 322 of the respective gun barrel housings 315, 325 can threadedly advance along the tandem sub 330. A pair of cap screws 340 have been run into the tandem sub 330 on opposing sides of the shoulder 306. Each cap screw 340 is advanced into a side port (shown at 345 in FIG. 5) residing within the tandem sub 330. Thus, a side port 345 resides on each end of the tandem sub 330 opposite the shoulder 306.

Figure 4:
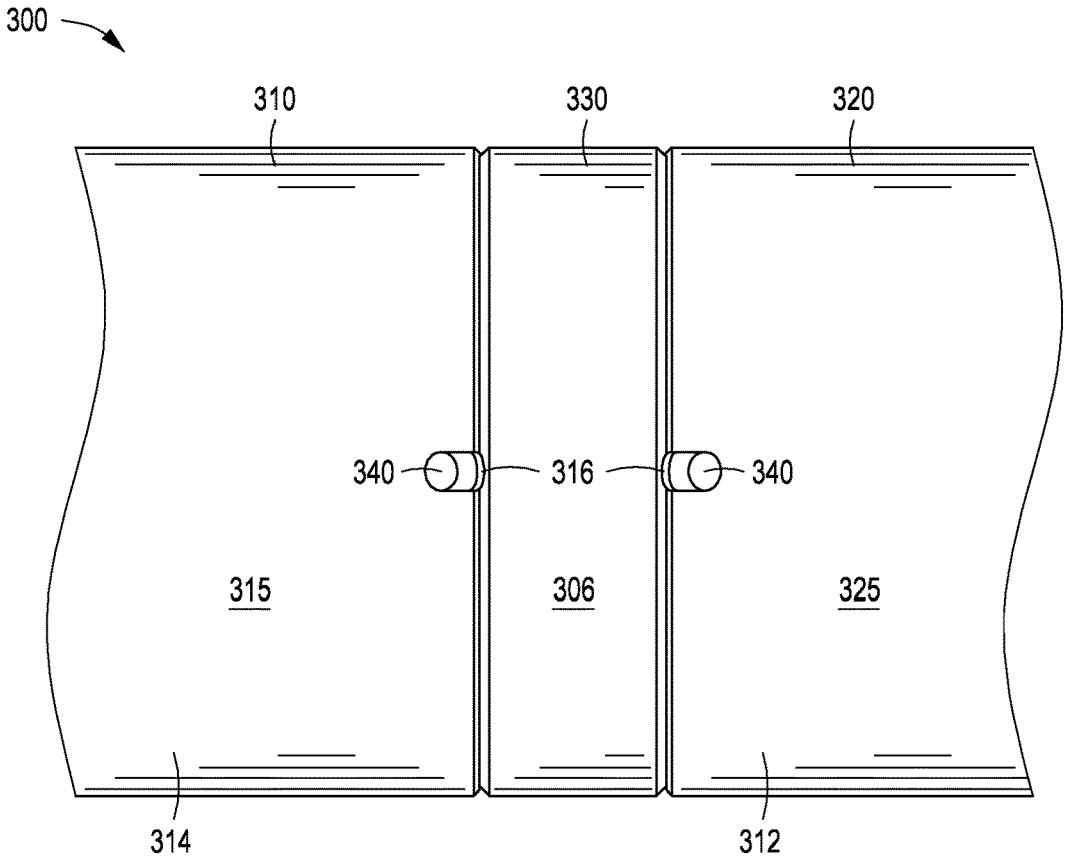
FIG. 4 is an enlarged plan view of a portion of the perforating gun assembly of FIG. 3, particularly showing two slots formed in opposing gun barrel housings.

FIG. 4 is an enlarged plan view of a portion of the perforating gun assembly 300 of FIG. 3. Here, the orienting tandem sub 330 is again shown, with the first 310 and second 320 perforating guns threaded onto the opposing ends of the tandem sub 330. In this view, it can be seen that each alignment screw 340 is aligned with a slot 316. The slots 316 are placed in respective ends (seen at 314 and 322 in FIG. 3) of the perforating guns 310, 320. While not visible, the slots 316 are aligned with side ports 345 in the tandem sub 330.

Figure 5:
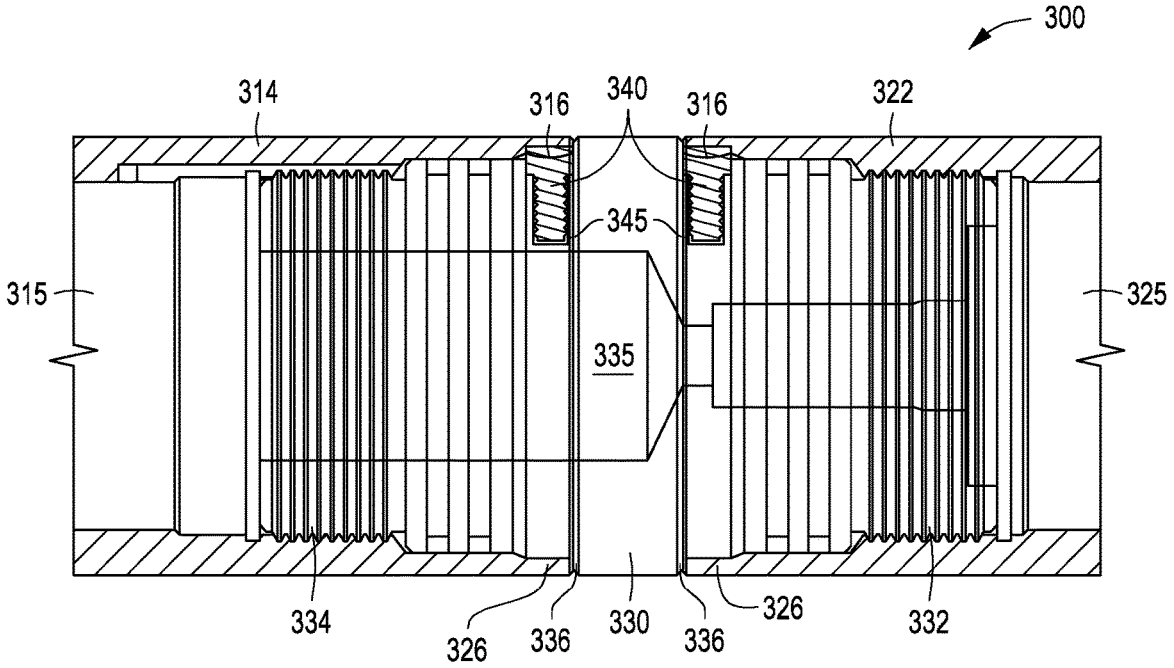
FIG. 5 is an enlarged side view of the perforating gun assembly of FIG. 3. In this view, opposing gun barrel housings are in cross-section while the orienting tandem sub is transparent, revealing an inner bore of the tandem sub.

FIG. 5 is another enlarged view of the perforating gun assembly 300 of FIG. 3. In this view, opposing gun barrel housings 315, 325 are in cross-section while the orienting tandem sub 330 is transparent, revealing the inner bore 335 of the tandem sub 330. Opposing ends 332, 334 of the tandem sub 330 are also visible.

In FIG. 5, it can be seen that the two alignment screws 340 have been fully run into the respective side ports 345. In addition, the opposing gun barrel housings 315, 325 have been advanced over the threaded ends 332, 334 of the tandem sub 330, all the way up to the shoulder 306. Note that the screws 340 are now covered in response to further rotation of the opposing gun barrel housings 315, 325.

Figure 6:
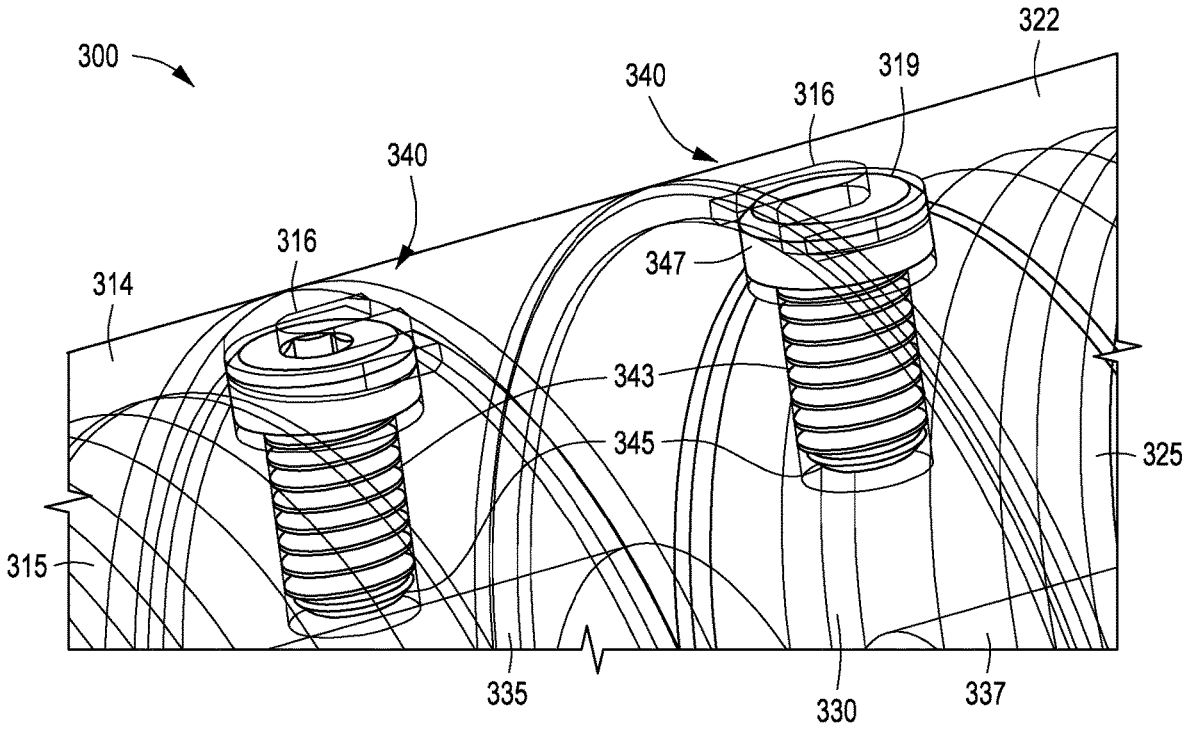
FIG. 6 is still another enlarged view of the perforating gun assembly of FIG. 3.

FIG. 6 is another enlarged view of the perforating gun assembly 300 of FIG. 3. FIG. 6 offers a perspective view of the alignment screws 340 used to fix a relative position of the two gun barrel housings 315, 325 along the tandem sub 330. Here, threaded shafts 343 of each alignment screw 340 are seen, extending into the side ports 345. In addition, it is observed that each alignment screw 340 includes a tapered head 347, tapering from the bottom up.

Of interest, the alignment screws 340 in FIGS. 5 and 6 have been run all the way into the side ports 345. The result is that the heads 347 reside below the slots 316 and below an inner diameter of the gun barrel housings 315, 325. This allows the female threaded ends 314, 322 of the perforating guns 310, 320 to be rotationally and threadedly placed onto the opposing ends 332, 334 of the tandem sub 330. In the view of FIG. 5, the female threaded ends 314, 322 are tightened all the way down onto opposing sides (identified at 336 of FIG. 5) of the tandem sub shoulder 306. In other words, a gun barrel shoulder 326 hits the tandem shoulder 306.

After the gun barrel housings 315, 325 have been threaded onto the opposing ends 332, 334 of the tandem sub 330, the gun barrel housings 315, 325 are slowly unthreaded (or backed away) from the shoulders 336 until the slots 316 are aligned with the alignment screw heads 347. Ideally, this will not take more than 720° (or two full turns) of rotation. Once the tapered head 347 of each alignment screw 340 is aligned with a slot 316, the alignment screw 340 is backed out into the tapered slot, that is, a stepped surface 319, in each gun barrel housing 315, 325. This serves to rotationally lock each gun barrel housing 315, 325 relative to the tandem sub 330.

Figure 7:
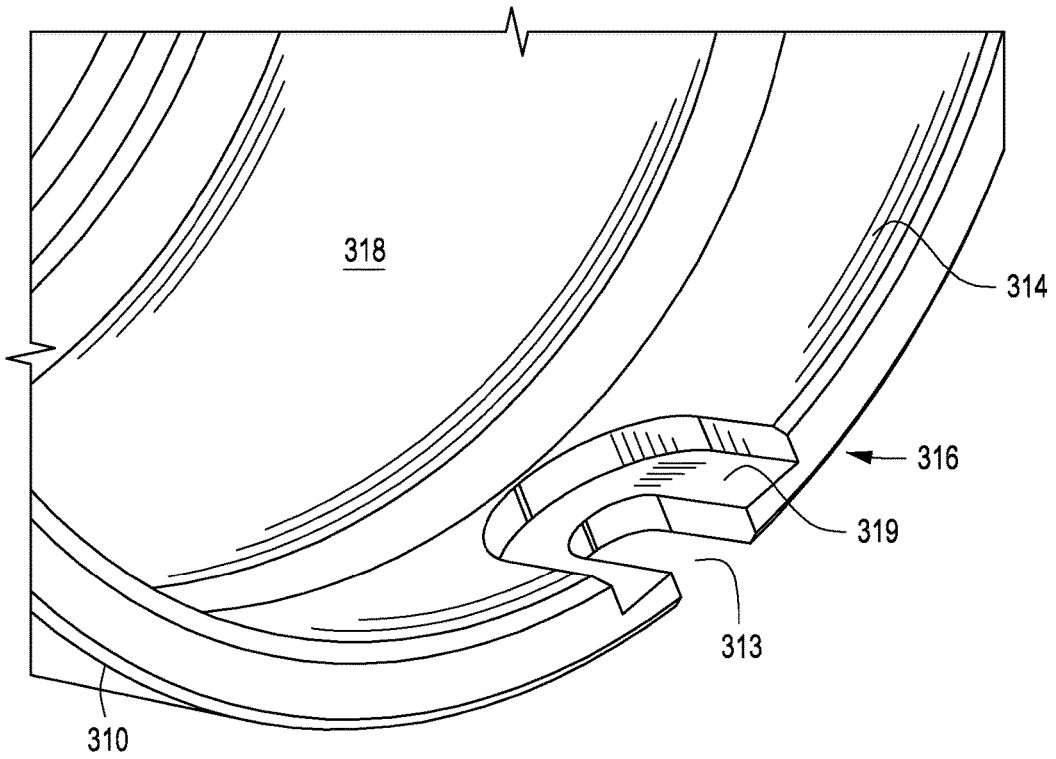
FIG. 7 is a perspective view of a slot as may be placed in the inner diameter at the end of a perforating gun, in one embodiment. This view is taken from inside the gun barrel housing.

FIG. 7 is a perspective view of a slot 316 as placed through an inner diameter 318 of a perforating gun, in one embodiment. In this case, the slot 316 resides at the second end 314 of the first perforating gun 310. It can be seen that the illustrative slot 316 includes a stepped surface 319 along the inner diameter 318. The stepped surface 319 is configured to receive the head 347 of an alignment screw 340 when the alignment screw 340 is backed out of the port 345. Preferably, each head 347 is a socket head cap screw.

As arranged in FIGS. 3-7, backing an alignment screw 340 out of the port 345 fixes a radial position of the perforating guns 310, 320 relative to the tandem sub 330. Ideally, the slot 316 in the gun barrel housing 315 is long enough that the full screw head diameter 347 is engaged by the slot 316 even if the gun barrel housing 315 has to be backed out one full rotation (depending, of course, on thread pitch).

The screw 340 is captured by the gun barrel housing 315 or 325 in case it becomes loose during operation, preventing the screw 340 from falling out in the wellbore. In one aspect, the screw 340 is made with a flange that captures it to simplify the orienting slot design in the gun barrel housing 315 or 325.

As part of the use of the perforating gun orienting system, the operator will align charges associated with the perforating guns 310, 320. Stated another way, the gun charges are linearly aligned between the first perforating gun 310 and the second perforating gun 320. Preferably, the slots 316 and cap screws 340 accommodate a full 360° rotation of the gun barrel housing 315. However, it is anticipated that alignment of the gun barrel slots 316 with respect side portals 345 will automatically align the charge openings 317.

FIG. 8 is a perspective view of an illustrative carrier tube 500. The carrier tube 500 defines an elongated tubular body 510. The tubular body 510 has an upstream end 522 and a downstream end 524. Each of the upstream end 522 and the downstream end 524 may define an end plate used to center the carrier tube 510 within a gun barrel, such as gun barrel 315.

Illustrative insulators 530, 540 are shown extending from the upstream 522 and downstream 524 ends of the body 510, respectively. Power and signal wires 545 may pass through these insulators 530, 540 en route to adjacent perforating guns.

The tubular body 510 also includes a series of charges 520. In the typical carrier tube arrangement, charges 520 are spaced apart radially and longitudinally along the tubular body 510, allowing shots to be fired in all radial directions through the casing 150. However, in the arrangement of FIG. 8, charges 520 are intentionally aligned at nominally 180° relation, allowing the operator to shoot charges horizontally from the wellbore once the perforating guns 310, 320 are in place.

Based on the tandem sub 330, the unique carrier tube 500, the alignment screws 340 and the perforating gun orienting system discussed above, a method of aligning shots in a perforating gun assembly is also provided herein. In one embodiment, the method first comprises providing a first perforating gun. The first perforating gun has a tubular housing having a first end and an opposing second end. The tubular housing serves as a gun barrel housing.

The method also includes providing a second perforating gun. As with the first perforating gun, the second perforating gun also includes a tubular housing having a first end and an opposing second end, and serves as a gun barrel housing.

The second end of the first perforating gun comprises a slot. Similarly, the first end of the second perforating gun also comprises a slot. Each slot may include a stepped surface along an inner diameter of the respective tubular housing. (The stepped surface is shown at 319 in FIG. 7.)

The method further includes providing a tandem sub. The tandem sub has first and second opposing ends, with each end defining a male threaded connector. In other words, a male-by-male tubular body is provided. Each end of the tandem sub includes a side port. The side ports are configured to receive a threaded alignment screw. (An enlarged view of the alignment screws having socket heads is shown in FIG. 6.)

In a preferred embodiment, the tandem sub also includes a circular shoulder. (The circular shoulder is shown at 306 in FIG. 3A, with shoulder ends seen at 336 in FIG. 5.) The circular shoulder serves as a stop when threadedly advancing the gun barrel housings onto the tandem sub.

The method additionally comprises running an alignment screw into each side port of the tandem sub such that a top of each alignment screw resides below an inner diameter of the tubular housing of the connected perforating guns. In one aspect, the operator simply runs the alignment screws all the way into the respective side ports. (Side ports are shown at 345 in FIGS. 3 and 5.)

As a next step, the method includes threadedly connecting the second end of the first perforating gun with the first end of the second perforating gun. This is done using the tandem sub as a threaded connector. Preferably, each of the first and second ends of each of the first and second perforating guns comprises female threads, forming a female-by-female tubular body. This allows the perforating guns to quickly and rotationally connect to the tandem sub. In one aspect, threadedly connecting the second end of the first perforating gun with the first end of the second perforating gun comprises threading each of the first and second perforating guns onto the tandem sub until a gun barrel shoulder is against a corresponding side of the tandem sub shoulder. Thus, the gun barrel housings "shoulder out" against the tandem sub.

The method further comprises rotationally unthreading each of the first and second perforating guns from the opposing ends of the tandem sub until the slots are lined up with an alignment screw in the respective side ports. (FIG. 5 best shows such an alignment.)

Also, the method includes rotationally aligning charges of each of the first and second perforating guns. This is done by further rotating each gun barrel housing relative to the tandem sub until the charges associated with each perforating gun are in linear alignment. Note that this rotational movement may be done without moving the slots out of alignment with the side ports, up to 360° and preferably up to 720° of rotation. (Charges are shown at 520 in FIG. 8.) Then, each alignment screw is backed out of its respective side port until a head of each alignment screw locks into an inner groove of the slot in the corresponding gun barrel housing. (The inner groove is a reference to the stepped inner surface 319 shown in FIG. 7.)

To accommodate this step, it is preferred that the head of each alignment screw comprises a tapered head that mates with the stepped surface. In addition, each slot in the perforating guns will have preferably have an open end. (The open end is shown at 313 in FIG. 7.)

In addition to providing alignment of the charges as between adjoining perforating guns, the charges are preferably oriented in a desired direction within the horizontal portion of a wellbore. In one preferred embodiment, the charges are placed so that they may deliver shots horizontally into the wellbore, either on one side of the casing or on both sides of the casing. To effectuate this, an eccentric weighting sub may be placed along a tool string comprising the perforating guns and the orienting tandem sub. Preferably, a pair of weighting subs are used, with one being placed at each end of the tool string.

Preferably, the charges are offset at 180° from each other, residing on opposing sides of a carrier tube. In one aspect, 3 to 5 charges reside on one side of a carrier tube while 3 to 5 charges reside on an opposing side of the carrier tube, offset by 180°. (Refer again to FIG. 8 showing charges 520 in nominally 180° relation.) In another aspect, the charges may be offset 45° to 60° from the weight of the eccentric weighting sub.

Figure 9:
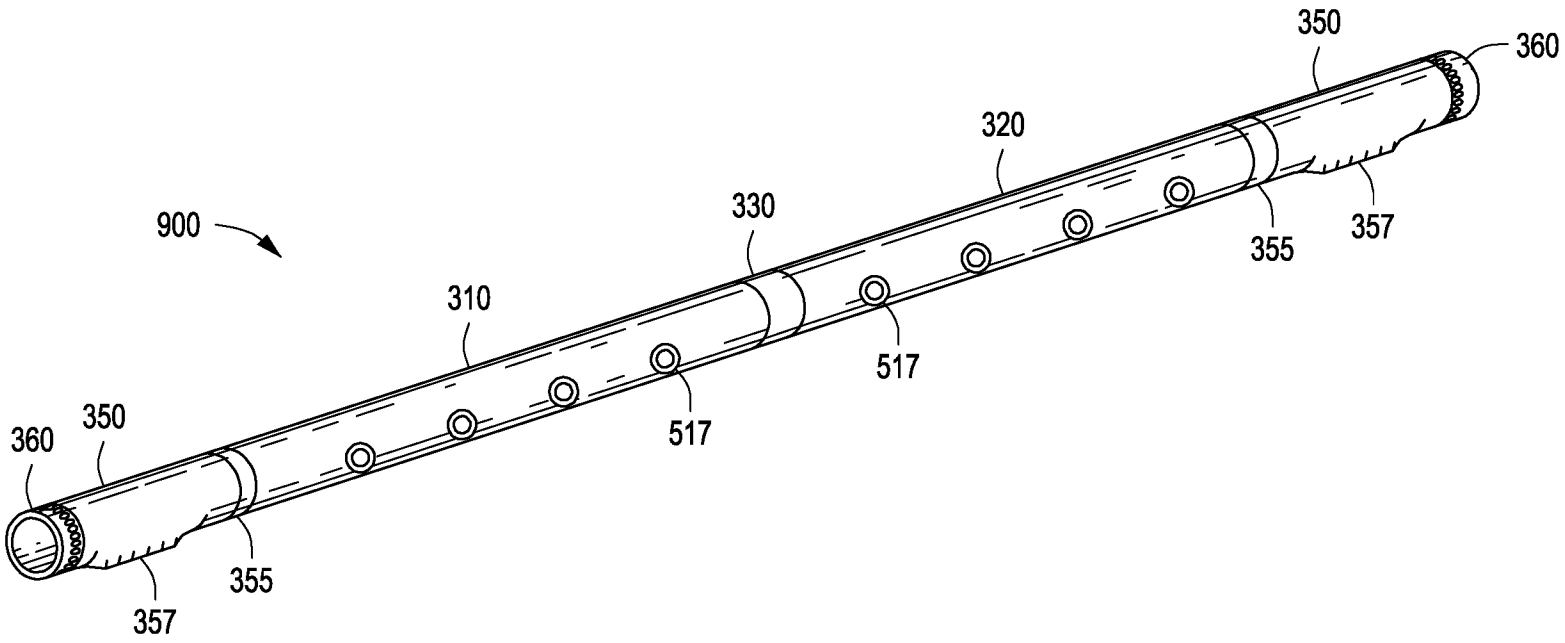
FIG. 9 is a perspective view of a perforating gun assembly of the present invention, in one embodiment. Here, two eccentric weighted subs are provided on opposing sides of perforating guns. Charge openings are shown along the perforating guns, having been rotated into alignment.

FIG. 9 is a perspective view of a perforating gun assembly 900 of the present invention, in one embodiment. A pair of perforating guns 310, 320 are shown. Charge openings 517 are visible along one side of each of the perforating guns 310, 320. A matching set of charge openings (not shown) is placed on the opposite side of the perforating guns 310, 320 at a 180° offset. It is understood that if the charge openings 517 are aligned, then the charges 520 themselves are also aligned.

The perforating guns 310, 320 are threadedly connected by means of a tandem sub 330. The tandem sub 330 is in accordance with the orienting tandem sub 330 described above in connection with FIGS. 3-7. In this way, the charges 520 of perforating gun 320 are aligned with the charges 520 of perforating gun 310.

At opposing ends of the perforating guns 310, 320 is a pair of tubular subs 350. Each sub 350 is weighted on one side, using weights 357. Each weighted sub 350 is connected to a perforating gun 310 or 320 by means of a threaded connection 355, which may be an end plate such as end plates 322 or 324 shown in FIG. 8.

In the arrangement of FIG. 9, each weighted sub 350 has an eccentric profile to accommodate the weights 357. It is apparent from FIG. 9 that the weights 357 have rotated into a downward position. To accommodate or to permit the rotation, bearing connectors 360 are provided. In FIG. 9, the weights 357 have rotated down, moving the charges 520 into a position where shots emanate directly into the longitudinal plane of the formation 115.

In one aspect, charges 520 are positioned on only one side of the perforating guns 310, 320. This enables the operator to shoot charges into only one side of a string of production casing 150. Then, when a hydraulic fracturing operation is conducted, fracturing fluid is injected in only one direction, such as in a direction away from a pressure sink caused by an existing parent wellbore. This may be beneficial if the operator wishes to avoid a frac hit.

Optionally, the method further comprises pumping the second perforating gun, the tandem sub and the first perforating gun into a wellbore at the end of an electric line. This is done prior to the actual shooting of charges at selected depths along the wellbore. The second perforating gun, the tandem sub, the first perforating gun, the charges and the opposing weighted subs form a perforating gun assembly.

Where one or more weighted, eccentric subs are used, the method may further comprise allowing the eccentric subs to rotate along respective bearings, thereby placing the charges associated with the perforating guns into a horizontal (or other desired) orientation.

Figure 10:
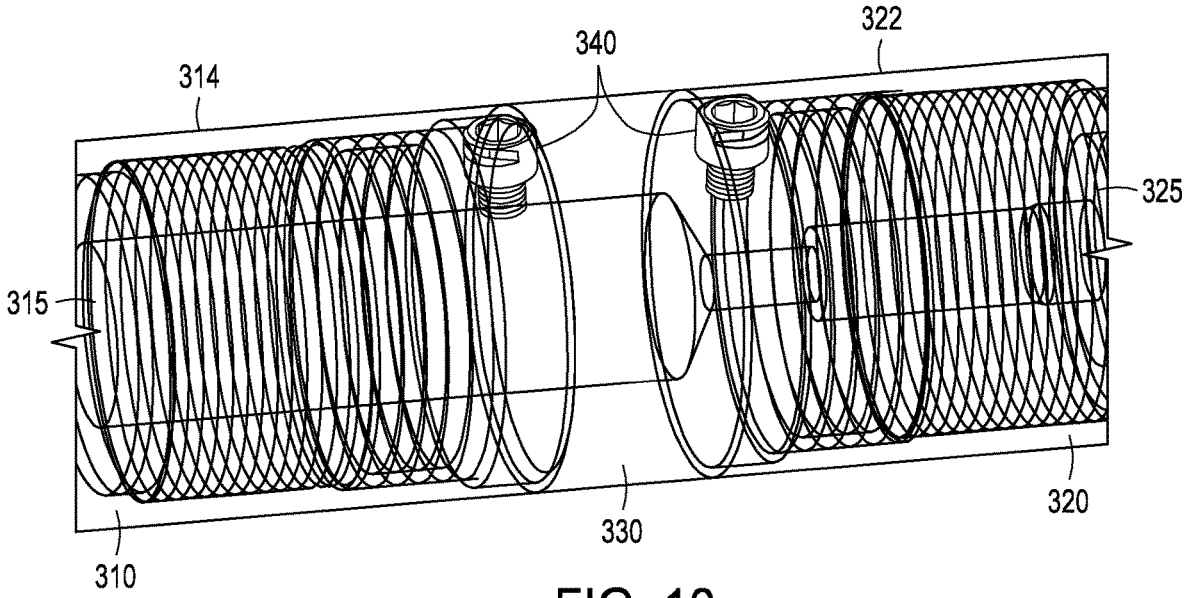
FIG. 10 is a cut-away view of two gun barrel housings connected by a tandem sub.

FIG. 10 is a cut-away view of the two gun barrel housings 315, 325 connected by the tandem sub 330. This figure demonstrates the use of cap screws 340 to fix a relative position of the two gun barrel housings 315, 325 along the tandem sub 330. The cap screws 340 are driven into respective slots 316 (shown on the same drawing sheet in FIG. 7) from the outside of the gun barrel housings 315, 325.

Figure 11:
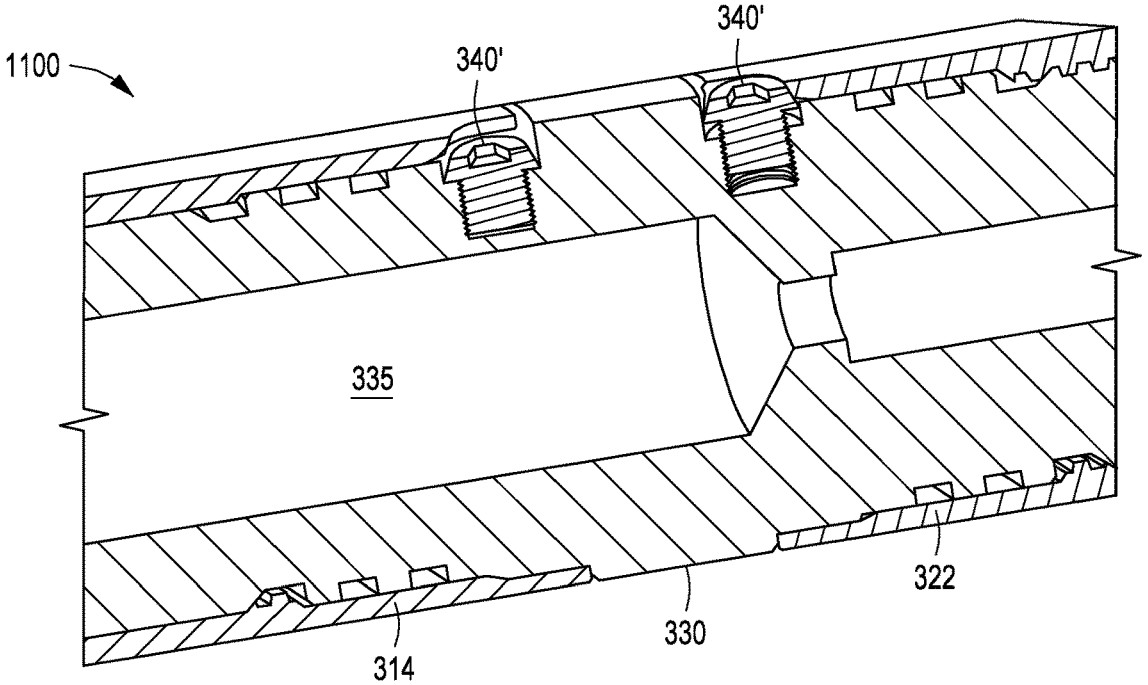
FIG. 11 is an enlarged, perspective, cross-sectional view of the cap screws and orienting tandem sub of FIG. 10. Two cap screws are shown different states of insertion through slots. Here, the screws have beveled (or tapered) heads.

There are alternate embodiments to the perforating gun orienting system as shown in FIGS. 3A and 5. FIG. 11 is an enlarged, perspective, cut-away view of an orienting system 1100 in such an alternate embodiment. The system 1100 is similar to the perforating gun assembly 300 of FIG. 3. In this respect, the system 1100 also uses a first 310 and a second 320 perforating gun threadedly connected to a tandem sub 330. In addition, alignment screws are again used. However, in the arrangement of FIG. 11, the gun barrel housings 315, 325 are oriented using taper-headed screws 34' in lieu of cap screws 340. This gives the added benefit of more accurate orientation.

Figure 12:
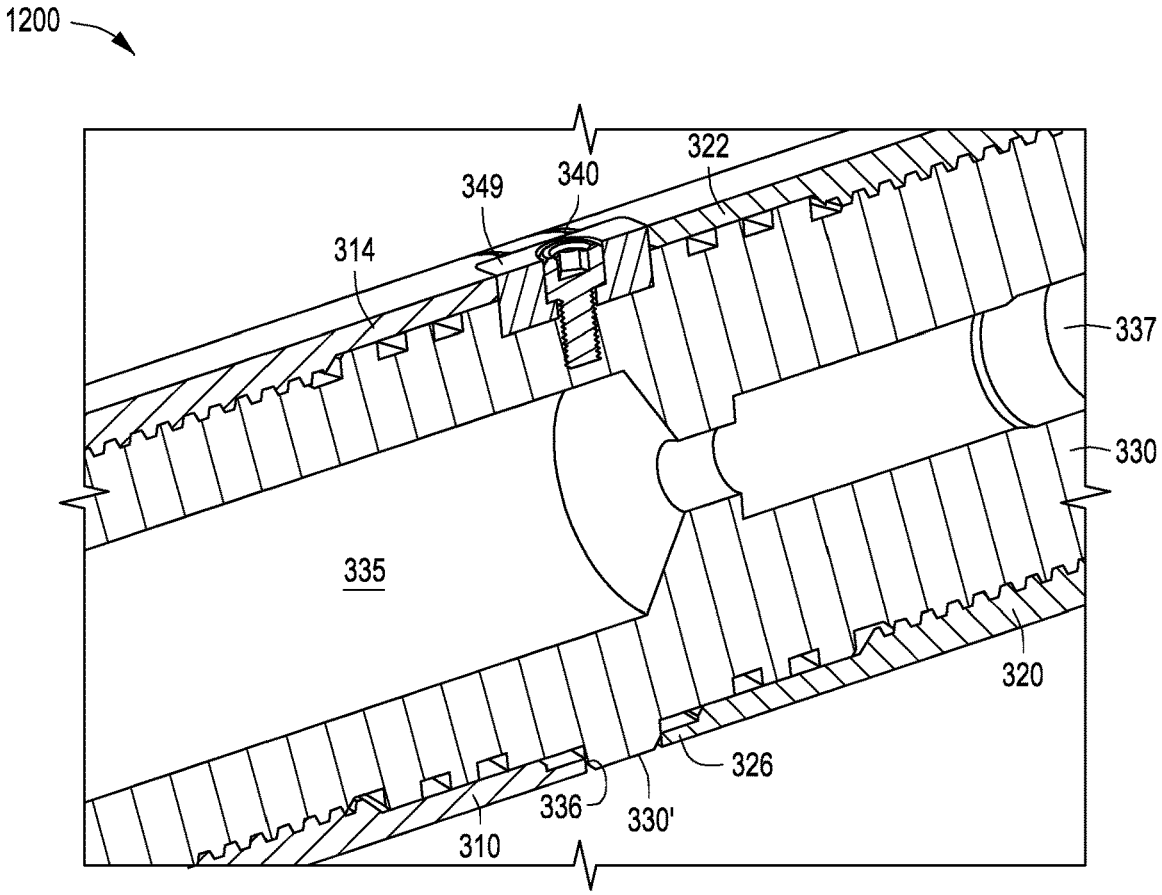
FIG. 12 is an enlarged, perspective, cross-sectional view of a cap screw placed along an orienting tandem sub, in an alternate embodiment.

FIG. 12 is an enlarged, perspective, cross-sectional view of a portion of a perforating gun orienting system 1200, in an alternate embodiment. Here, a cap screw 340 is placed along an orienting tandem sub 330'. Of interest, the system 1200 employs a single alignment screw 340 A screw-on key 349 is used for barrel orientation. The key 349 can be designed in such a way that it is also captured by the gun barrels 315, 325 after they are threaded in place.

As can be seen, a method of aligning charge shots in a perforating gun assembly is provided herein. The method employs the perforating gun orienting system as described above, in its various embodiments. In the system, first and second perforating guns are provided, wherein each perforating gun has a gun barrel housing having a slot. Each gun barrel housing provides female threads, which connect to a male-by-male threaded tandem sub. Beneficially, the tandem sub includes side ports at opposing ends.

In operation, a pair of alignment screws is provided. Each alignment screw is run into a side port in the tandem sub. The gun barrel housings are then threaded onto the tandem sub at opposing ends, and the charges of the two perforating guns are placed in alignment. Each gun barrel includes a slot that is rotationally aligned with a respective alignment screw (as residing within a side port). The alignment screw is then unthreaded, or backed out, of the side ports and locked into a respective gun barrel slot. This, in turn, places the charges in the respective perforating guns in fixed alignment.

In some cases, the operator may desire that shots be fired not only horizontally, but also in one direction only. This helps the service company generate and propagate fractures in a particular part of a formation, which may be of benefit in avoiding frac hits. Those of ordinary skill in the art will appreciate that frac hits are generally a by-product of in-fill drilling, meaning that a new wellbore (sometimes referred to as a "child well") is being completed in proximity to existing wellbores (referred to as "offset" or "parent wells") within a hydrocarbon-producing field. Frac hits are also, of course, a by-product of tight well spacing. Ultimately, however, frac hits are the result of the operator being unable to control or "direct" the propagation of fractures within the pay zone.

Based on the disclosure provided above, a method of avoiding a frac hit in a hydrocarbon producing field is also provided. In one embodiment, the method first comprises locating a parent wellbore in a hydrocarbon producing field. Similarly, the method also includes locating a child wellbore in the hydrocarbon producing field. The child well is sometimes referred to as an "offset well."

The method additionally includes running a perforating gun assembly into the child wellbore. The perforating gun assembly is constructed in accordance with the perforating gun assembly described above, in its various embodiment.

The method then includes:

running an alignment screw into each side port of the tandem sub such that a top of each alignment screw resides below an inner diameter of the tubular housing of the perforating guns;

using the tandem sub, threadedly connecting the second end of the first perforating gun with the first end of the second perforating gun;

rotationally unthreading each of the first and second perforating guns from opposing ends of the tandem sub until each slot is lined up with the alignment screw in the respective side port;

rotating one or both of the first and second perforating guns relative to the tandem sum, thereby linearly aligning charges of each of the first and second perforating guns such that all charges are aligned in a single direction;

backing each alignment screw out of its respective side port until a head of each alignment screw hits an inner groove of the slot in the corresponding perforating gun;

running the perforating gun assembly into the wellbore at the end of an electric line; and pumping the perforating gun assembly into a horizontal leg of the wellbore to a selected depth, wherein the charges are aligned to fire shots into the formation at a horizontal azimuth and in a direction away from the parent wellbore.

In connection with avoiding a frac hit, the method may further comprise:

connecting a weighted sub to the perforating gun assembly by means of a bearing connection; and permitting the weighted sub and connected perforating gun assembly to rotate within the horizontal leg, thereby placing the charges in position to fire at a longitudinal plane of a surrounding formation.

In order to provide this orientation, current practice is to employ a weight bar. The weight bar is placed along an eccentric sub having bearings at each end. Once the perforating gun assembly is in place, the weight bar will rotate into position at the bottom (relative to vertical) of the wellbore, thereby orienting the perforating guns and placing the charges at a horizontal position.

The method may further include sending an actuation signal down the electric line to initiate charges and to create perforations in a direction that is generally opposite from a direction of the parent wellbore.

Further, variations of the tool and of methods for using the tool within a wellbore may fall within the spirit of the claims, below. It will be appreciated that the inventions are susceptible to other modifications, variations and changes without departing from the spirit thereof.

We claim:

1. A perforating gun orienting system, comprising:

a first perforating gun, the first perforating gun comprising a tubular gun barrel having a first end and an opposing second end;

a second perforating gun, the second perforating gun also comprising a tubular gun barrel having a first end and an opposing second end;

a tandem sub, the tandem sub having first and second opposing ends, with each end defining a threaded connector, and each end having a side port configured to receive a threaded alignment screw;

first and second alignment screws, each having a head for driving the screws into the respective side ports;

a first slot placed at the second end of the gun barrel of the first perforating gun, wherein the first slot is configured to align with the first alignment screw within a side port upon rotation of the first perforating gun onto the first end of the tandem sub;

a second slot placed at the first end of the gun barrel of the second perforating gun, wherein the second slot is configured to align with the second alignment screw within a side port upon rotation of the second perforating gun onto the second end of the tandem sub;

wherein after each alignment screw has been run into its respective side port, the alignment screw is configured to land in a respective slot along an inner diameter of a respective gun barrel when backed back out of the side port, thereby rotationally locking each of the first and second perforating guns relative to the tandem sub.

2. The orienting system of claim 1, wherein:

each of the first and second opposing ends of the tandem sub comprises male threads such that the tandem sub serves as a male-by-male threaded connector; and each of the first and second ends of each of the first and second perforating guns comprises female threads, forming a female-by-female tubular body.

3. The orienting system of claim 2, wherein:

each gun barrel housing comprises a plurality of charge openings;

each of the first and second perforating guns comprises a carrier tube within the gun barrel carrying a plurality of charges, with the carrier tube being rotationally fixed within the corresponding gun barrel housing so that each of the charges is aligned with a charge opening; and the charges of the first perforating gun and the charges of the second perforating gun are in alignment when the gun barrel housing of the first perforating gun and the gun barrel housing of the second perforating gun are rotationally locked relative to the tandem sub.

4. The orienting system of claim 3, wherein the plurality of charges of each of the first and second perforating guns are aligned in two rows, with the two rows being offset from each other by 180°.

5. The orienting system of claim 3, wherein the plurality of charges of each of the first and second perforating guns are aligned in a single row.

6. The orienting system of claim 3, wherein each of the first and second slots includes a stepped surface along an inner diameter of the respective tubular gun barrel for receiving the head of a respective alignment screw when the screw is backed out of its side port.

7. The orienting system of claim 6, wherein the head of each alignment screw comprises a tapered head that mates with the stepped surface when backed out of its side port.

8. A perforating gun assembly, comprising:

a first perforating gun, the first perforating gun comprising a first tubular gun barrel having a first end and an opposing second end, and a carrier tube residing within the first gun barrel;

a plurality of charges held by the carrier tube in the first perforating gun;

a second perforating gun, the second perforating gun comprising a second tubular gun barrel having a first end and an opposing second end, and a carrier tube residing within the second gun barrel;

a plurality of charges held by the carrier tube in the second perforating gun;

a tandem sub, the tandem sub having first and second opposing ends;

a first alignment screw rotationally locking the first perforating gun with the tandem sub; and a second alignment screw rotationally locking the second perforating gun with the tandem sub;

and wherein:

the second end of the first gun barrel is threadedly connected to the first end of the tandem sub;

the first end of the second gun barrel is threadedly connected to the second end of the tandem sub;

at least two charges within the carrier tube of the first perforating gun are rotationally fixed at a designated altitude along the first gun barrel, and at least two charges within the carrier tube of the second perforating gun are rotationally fixed at the same designated altitude along the second gun barrel so that the at least two charges of the first perforating gun are aligned with the at least two charges of the second perforating gun.

9. The perforating gun assembly of claim 8, wherein:

each of the first and second opposing ends of the tandem sub comprises male threads such that the tandem sub serves as a male-by-male threaded connector; and each of the first and second ends of each of the first and second perforating guns comprises female threads, forming a female-by-female tubular body.

10. The perforating gun assembly of claim 9, wherein each of the first and second opposing ends of the tandem sub further comprises a side port;

a first slot resides at the second end of the first gun barrel, wherein the first slot is configured to align with the first alignment screw upon rotation of the first perforating gun onto the first end of the tandem sub; and a second slot resides at the first end of the second gun barrel, wherein the second slot is configured to align with the second alignment screw upon rotation of the second perforating gun onto the second end of the tandem sub.

11. The perforating gun assembly of claim 10, wherein:

each of the first and second alignment screws comprises a head for driving the screws into the respective first and second slots;

the head of each alignment screw clears an inner diameter of a respective perforating gun when threadedly run into its side port, each of the first and second slots comprises a stepped under-surface; and the head of each alignment screw is configured to land in the stepped under-surface of its respective slot when backed out of the side port, thereby rotationally locking each gun barrel relative to the tandem sub.

12. The perforating gun assembly of claim 10, wherein:

each gun barrel housing comprises a plurality of charge openings;

the carrier tube within each of the first and second perforating guns is rotationally fixed within the corresponding gun barrel so that each of the charges is aligned with a charge opening; and the at least two charges of each of the first and second perforating guns comprise two rows of charges along each of the first and second perforating guns, with the two rows being offset from each other by 180°.

13. A method of aligning shots in a perforating gun assembly, comprising:

providing a first perforating gun, the first perforating gun comprising a tubular gun barrel having a first end and a second opposing end, wherein the second end comprises a slot;

providing a second perforating gun, the second perforating gun also comprising a gun barrel having a first end and a second opposing end, and wherein the first end also comprises a slot;

providing a tandem sub, the tandem sub having first and second opposing ends, with each end defining a male threaded connector, and each end having a side port configured to receive a threaded alignment screw;

threadedly connecting the second end of the first perforating gun with the first end of the second perforating gun;

running an alignment screw into each side port of the tandem sub;

rotationally unthreading each of the first and second perforating guns from the opposing ends of the tandem sub until each slot is lined up with a respective side port;

linearly aligning charges of each of the first and second perforating guns by rotating the first perforating gun, the second perforating gun, or both relative to the tandem sub; and backing each alignment screw out of its respective side port until a head of each alignment screw locks into the slot of the corresponding perforating gun.

14. The method of claim 13, wherein each of the first and second ends of each of the first and second perforating guns comprises female threads, forming a female-by-female tubular body; and threadedly connecting the second end of the first perforating gun with the first end of the second perforating gun comprises threading each of the first and second perforating guns onto an end of the tandem sub until a gun barrel shoulder associated with each of the first and second perforating guns is against a corresponding tandem sub shoulder.

15. The method of claim 14, wherein:

the first perforating gun, the tandem sub and the second perforating gun comprise a perforating gun assembly;

the perforating gun assembly further comprises at least one weighted, eccentric sub bearingly connected to the first end of the gun barrel of the first perforating gun; and the method further comprises:

running the perforating gun assembly into a wellbore at the end of an electric line;

pumping the perforating gun assembly into a horizontal portion of the wellbore; and allowing the eccentric sub to rotate along a bearing, thereby placing the charges of each of the first and second perforating guns into a horizontal orientation.

16. The method of claim 14, wherein:

running an alignment screw into each side port of the tandem sub is done before the first and second perforating guns are threadedly connected; and a top of each alignment screw resides below an inner diameter of the gun barrel of a corresponding perforating gun before the alignment screw is backed out of its respective side port.

17. The method of claim 14, wherein the charges of each of the first and second perforating guns comprise two rows of charges along each of the first and second gun barrels, with the two rows being offset from each other by 180°.

18. The method of claim 14, wherein the charges of each of the first and second perforating guns are each aligned along a single row.

19. The method of claim 13, wherein:

each slot includes a stepped surface along an inner diameter of the respective tubular gun barrel; and the head of each alignment screw comprises a tapered head that mates with its corresponding stepped surface as each alignment screw is backed out of its respective side port.

* * * * *